US006116726A

United States Patent [19]

Driggers

[11] Patent Number: 6,116,726

[45] Date of Patent: Sep. 12, 2000

[54] INK JET PRINTER CARTRIDGE WITH INERTIALLY-DRIVEN AIR EVACUATION APPARATUS AND METHOD

[75] Inventor: Matt G. Driggers, Vancouver, Wash.

[73] Assignee: Hewlett-Packard Company, Palo Alto, Calif.

[21] Appl. No.: 09/086,786

[22] Filed: May 28, 1998

[51] Int. Cl.[7] ..... B41J 2/175

[52] U.S. Cl. ..... 347/87

[58] Field of Search ..... 347/6, 7, 84, 85, 347/86, 87, 92

[56] References Cited

U.S. PATENT DOCUMENTS

| | | | |
|---|---|---|---|
| 4,788,556 | 11/1988 | Hoisington et al. | 347/92 |
| 5,138,332 | 8/1992 | Carlotta | 347/92 |
| 5,341,162 | 8/1994 | Hermanson et al. | 347/92 |
| 5,394,181 | 2/1995 | Braun | 347/92 |
| 5,621,444 | 4/1997 | Beeson | 347/88 |
| 5,677,718 | 10/1997 | Crawford et al. | 347/92 |
| 5,701,148 | 12/1997 | Moynihan et al. | 347/92 |
| 5,812,155 | 9/1998 | Seccombe | 347/6 |

FOREIGN PATENT DOCUMENTS

| | | | |
|---|---|---|---|
| 0 041 777 | 12/1981 | European Pat. Off. | B41J 2/79 |
| 196 16 825 | 6/1997 | Germany | B41J 2/17 |

*Primary Examiner*—N. Le
*Assistant Examiner*—Anh T. N. Vo

[57] ABSTRACT

An ink jet print cartridge with a body defining an ink chamber and an air outlet. A movable inertia element is connected to the body, and a compressor element is connected to the inertia element and the air outlet. When the pen is accelerated in a selected direction, such as along the carriage path of a printer during printing, the resulting motion of the inertia element operates the compressor to pump a small amount of air from the chamber. To avoid excessive pumping, which may expel ink unintentionally after the air has been expelled, a buoyant ink level detector in the cartridge may prevent air pumping when the ink is above a preselected level.

20 Claims, 6 Drawing Sheets

INK JET PRINTER CARTRIDGE WITH INERTIALLY-DRIVEN AIR EVACUATION APPARATUS AND METHOD

FIELD OF THE INVENTION

This invention relates to methods and apparatus for ink jet printing, and more particularly to removal of excess air and other gasses from ink jet cartridges.

BACKGROUND AND SUMMARY OF THE INVENTION

In ink jet printers, ink jet print cartridges or pens are reciprocated on a carriage to print swaths on an advancing media sheet. Pens typically include an ink chamber partially filled with ink, with a print head having an array of nozzles for expelling ink droplets in a controlled pattern. Some existing pens are self contained units that are discarded when ink is depleted.

More advanced pens employ permanent or rarely-replaced pens and associated replaceable ink supply reservoirs. Upon disconnecting depleted reservoirs and connecting new reservoirs, air bubbles may be admitted into the pen, particularly if the reservoir is connected to the pen via an elongated tube that may be empty of ink and filled with air. As the pen is increasingly filled with air upon each reservoir replacement, or as air enters by any other means, the pen's ink capacity is reduced, and clogging of smaller passages by air bubbles may occur. In addition, when the volume of an air bubble becomes a substantial percentage of the ink chamber volume, external barometric pressure changes such as occur during air travel may cause the bubble to expand enough to expel ink through the nozzles. Therefore, there is a need to remove excess air from the pen.

Simply providing a vent for air to escape is disadvantageous. To prevent ink from "drooling" from the nozzles when the pen is not in use, the pen is maintained at a slight underpressure, which is slightly less than the atmospheric pressure outside the pen. Pens have been provided with air inlet check valves that admit air to avoid excessive back pressure as ink is displaced, but these prevent excess air from escaping. Further, because of the slight under pressure in the pen, any vent would let more air in, instead of letting air out as desired. In the absence of a means to expel excess air, an otherwise-functional pen may fail, requiring replacement before the end of its intended life.

The present invention overcomes the limitations of the prior art by providing an ink jet print cartridge with a body defining an ink chamber and an air outlet. A movable inertia element is connected to the body, and a compressor element is connected to the inertia element and the air outlet. When the pen is accelerated in a selected direction, such as along the carriage path of a printer during printing, the resulting motion of the inertia element operates the compressor to pump a small amount of air from the chamber. To avoid excessive pumping, which may expel ink unintentionally after the air has been expelled, a buoyant or other ink level detector in the cartridge may prevent air pumping when the ink is above a preselected level.

DETAILED DESCRIPTION OF A PREFERRED EMBODIMENT

Figure 1:
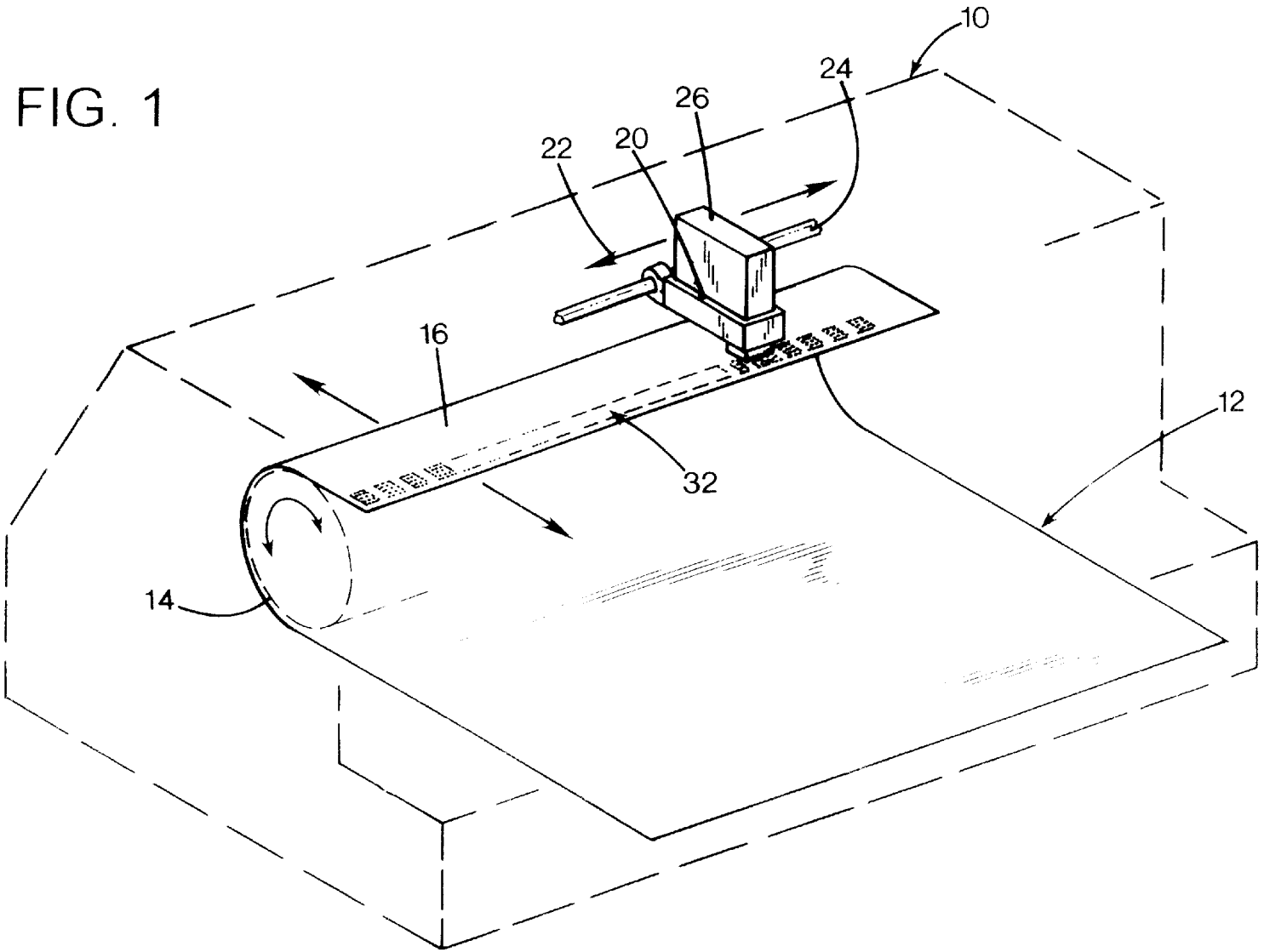
FIG. 1 is a simplified perspective view of an ink jet printer according to a preferred embodiment of the invention.

FIG. 1 shows an ink jet printer 10 into which a sheet of printer media 12 has been loaded. The printer has a media drive mechanism 14 that feeds the sheet along a paper path, with motion of the sheet defining a feed axis 16. A print head carriage 20 reciprocates along a scan axis 22 on a guide rod 24, and carries a print cartridge 26 that expels ink droplets onto the media surface to generate a desired printed image 32. During normal operation, the carriage reciprocates at a constant velocity along the scan axis, except near the ends of its travel, where it experiences substantial acceleration of about 0.4 g–3.0 g as it reverses direction.

Figure 2:
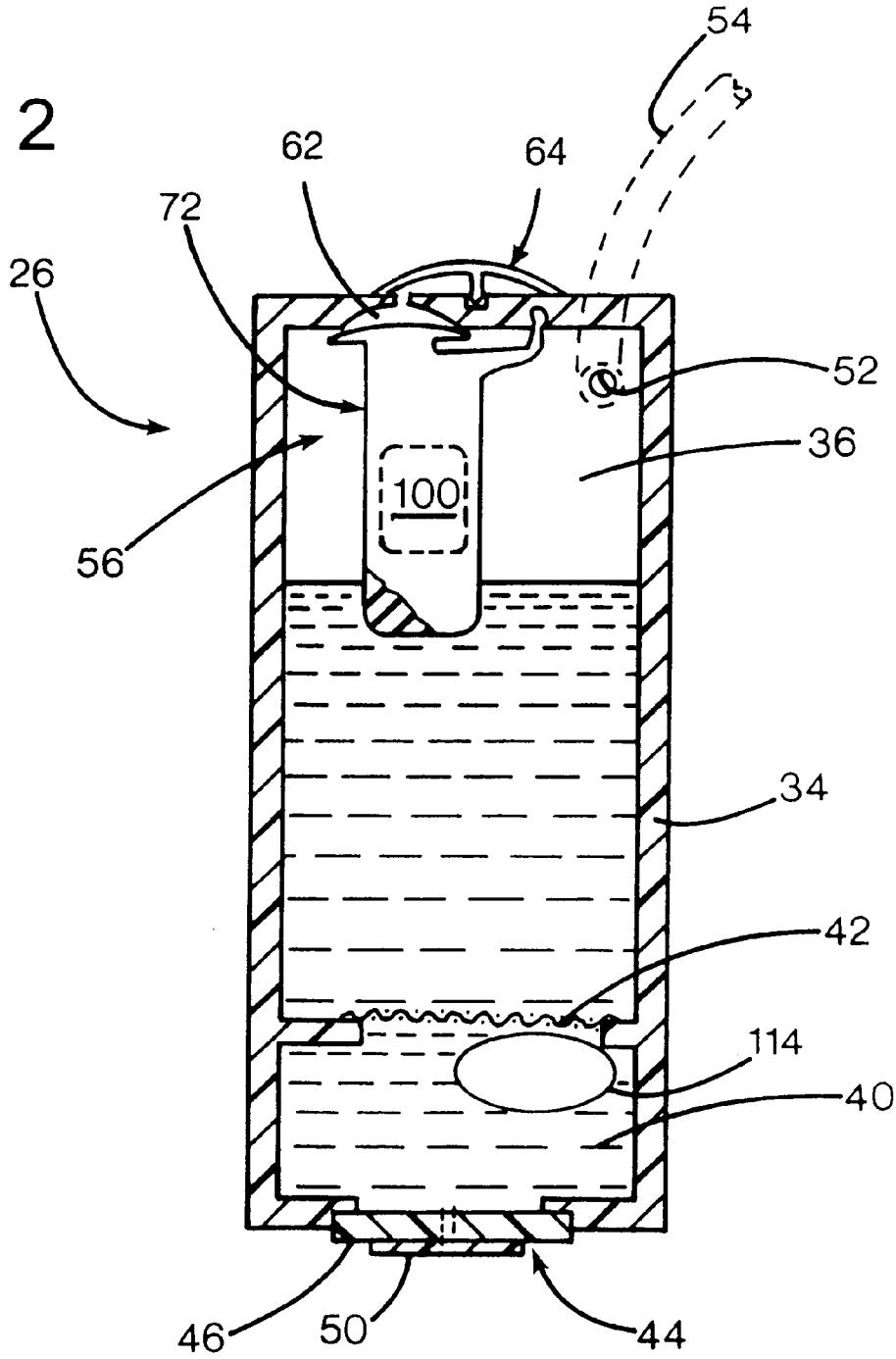
FIG. 2 is sectional front view of an ink jet print head cartridge according to the embodiment of FIG. 1.

FIG. 2 shows the print cartridge 26 in greater detail. The cartridge includes a rigid housing 34 defining an upper ink chamber 36 and a lower ink chamber 40. The ink chambers are separated by a fine mesh screen 42 that permits passage of ink, but which filters particles to prevent their passage from the upper chamber to the lower chamber. A print head 44 encloses the lower portion of the lower chamber, and includes a silicon die 46 having ink channels and containing firing resistors for a thermal ink jet pen. An orifice plate 50 covers the exposed surface of the die and defines finely spaced arrays of nozzles through which ink is expelled.

In the upper chamber portion, an optional ink inlet 52 receives ink from a detachable ink conduit 54 that connects to an external supply of ink (not shown) so that the cartridge and print head may continue to be used even after the initial supply of ink in the cartridge is depleted. A pump or compressor mechanism 56 provides means for evacuating excess air from the chamber automatically in response to the acceleration imparted to the cartridge as it changes direction during carriage reciprocation.

Figure 3:
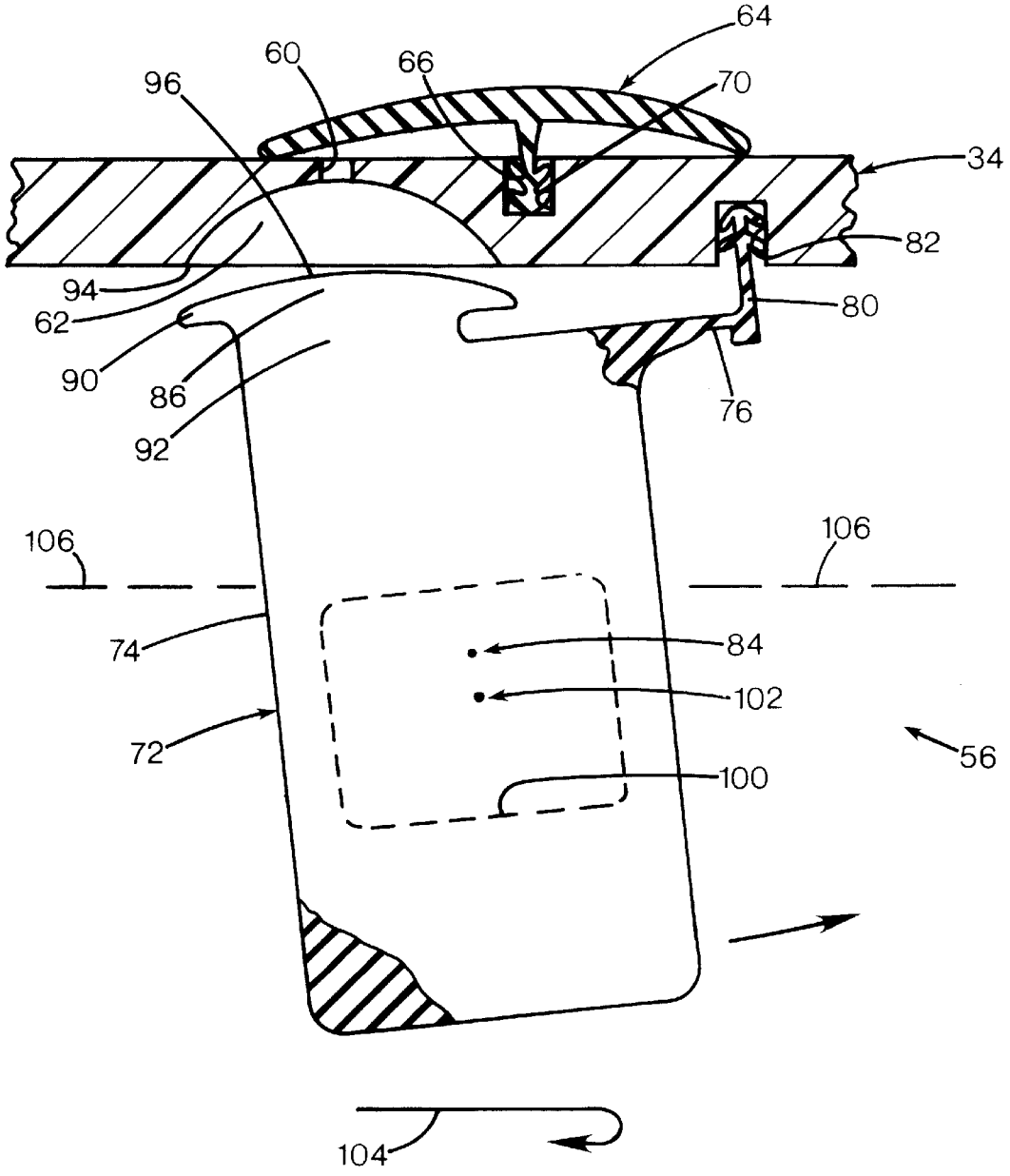
FIGS. 3–6 are enlarged sectional views of an inertial air pump mechanism according to the embodiment of FIG. 1, at different stages of operation.

As shown in FIG. 3, the cartridge body defines a small air outlet aperture 60 in an upper surface, with a concave-domed recess or compression chamber 62 registered with the aperture and facing into the interior of the chamber. A check valve 64 is connected to the exterior of the body 34 to cover the aperture 60 to prevent air entering the cartridge chamber and to allow air to escape the chamber. The check valve permits the chamber pressure to be maintained at a slight underpressure relative to environmental air pressure, typically about at 4 inches of water, or about a one percent vacuum. In the illustrated embodiment, the valve is a flexible plastic dished disc, concave downward against the smooth upper surface of the body 34. A downwardly protruding central anchor 66 is received in a closely-sized pocket 70 in the upper surface of the body. The valve center is biased slightly downward to maintain contact about the periphery of the disc with the body surface. As an underpressure develops in the chamber initially during use, the valve will remain seated against the surface.

In alternative embodiments, any other type of check valve may be used, such as a flapper or ball valve, or a microscopic valve formed in the silicon material of the print head die or other chip. The valve may further be located anywhere on the cartridge, as long as an inlet communicating with the valve is plumbed through a conduit having one end opening into the chamber at an upper portion where an air bubble would normally reside.

In the preferred embodiment, the pump mechanism includes a movable mass element 72 having a major body 74 that is hinged or pivotally attached at an upper lateral edge by a hinge 76 or pivot to an integral anchor 80. The anchor has a barbed end secured into an interior pocket 82 in the upper wall of the cartridge body 34 adjacent the air outlet 60 and compression chamber 62. The mass element is formed of a flexible elastomer, so that it swings freely at the hinge. The center of mass 84 is at a level well below the hinge 76, so that lateral acceleration of the cartridge will generate swinging of the mass about the hinge.

The mass element includes a compressor pad 86 at the upper surface of the mass, laterally away from the hinge 76, and registered with the compression chamber 62. The pad 86 has horizontally-oriented circular flexible rim or flange 90 extending radially from and supported by a neck portion 92 of the mass 72. The rim 90 has a diameter slightly greater than the edge 94 of the compression chamber, and is flexibly compliant to seal against the edge when brought into contact. The neck has a diameter smaller than the compression chamber edge, and the compressor pad 86 has an upper surface 96 that is slightly convex, but less curved than the interior of the compression chamber. Thus, contact between the compressor rim 90 and the compression chamber edge 94 creates an enclosed chamber of positive volume. In alternative embodiments, such a compression chamber may be formed with a flat pad surface 96 and a dished recess 62, or a convex pad may be used in conjunction with a flat or concave surface at the air outlet 60.

The mass element 72 defines a buoyancy chamber 100 filled with air to make the entire mass element substantially less dense than the ink that will occupy the chamber. The buoyancy chamber 100 is laterally offset away from the hinge 76, preferably below the compressor pad 86, so that buoyant forces on the mass by fluid above a selected level will force the pad to press against the recess 62. The buoyant force should substantial enough to maintain contact and pressure even when carriage acceleration forces tend to pivot the mass away from the recess. Thus, the mass may be designed for expected accelerations by positioning the buoyancy chamber at a position to provide a center of buoyancy 102 low enough to provide ample upward force when the ink level is a safe margin below the top of the chamber.

Such design geometry avoids the chance of continuing pumping after all air is expelled, which would cause ink leakage through the air outlet. In an alternative embodiment, the entire mass element may be formed of a foamed elastomer to provide mass and buoyancy. Alternatively, the mass element may be a dense member suspended below the pivot on one downwardly-depending arm of a bell crank, while the compressor and a buoyancy device are carried on a laterally-extending arm of the bell crank.

OPERATION

FIG. 3 shows the inertial pump in an open or intake position, with arrow 104 representing that the carriage is accelerating in a leftward direction in a transition from a rightward pass to a leftward pass. The ink level is below a selected threshold level 106, allowing the pump to operate. The lower portion of the mass swings rightward, opening the compressor chamber. Although not shown, a stop may limit rightward motion of the mass.

Figure 4:
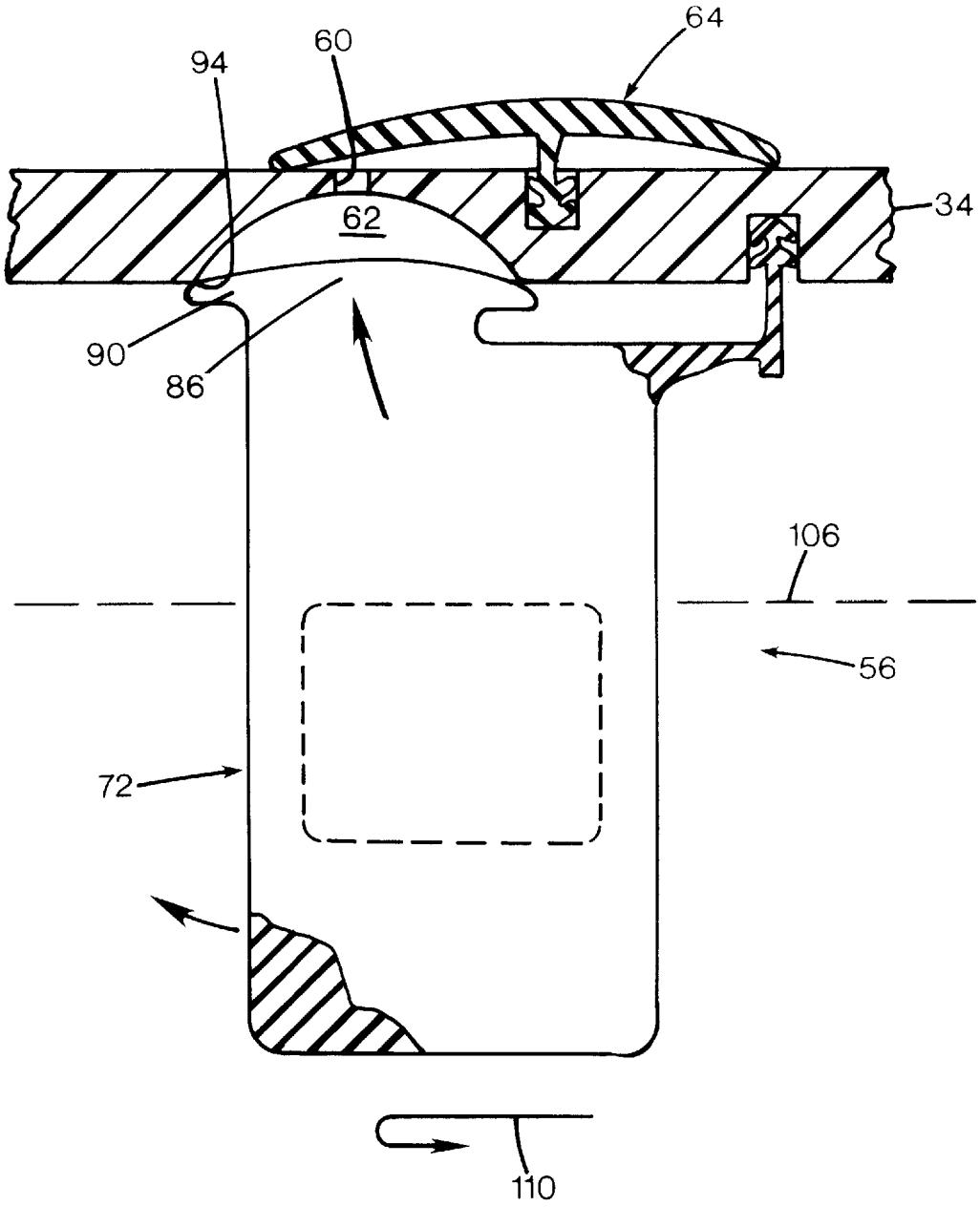

In FIG. 4, the pump 56 is in a momentary position during rightward acceleration as the carriage is transitioning from leftward to rightward movement, as indicated by arrow 110. In this position, the mass is in the process of pivoting leftward so that the compressor element 86 has moved upward. At the illustrated instant, the compression chamber has just been closed by contact between the compressor rim 90 and the chamber edge 94.

Figure 5:
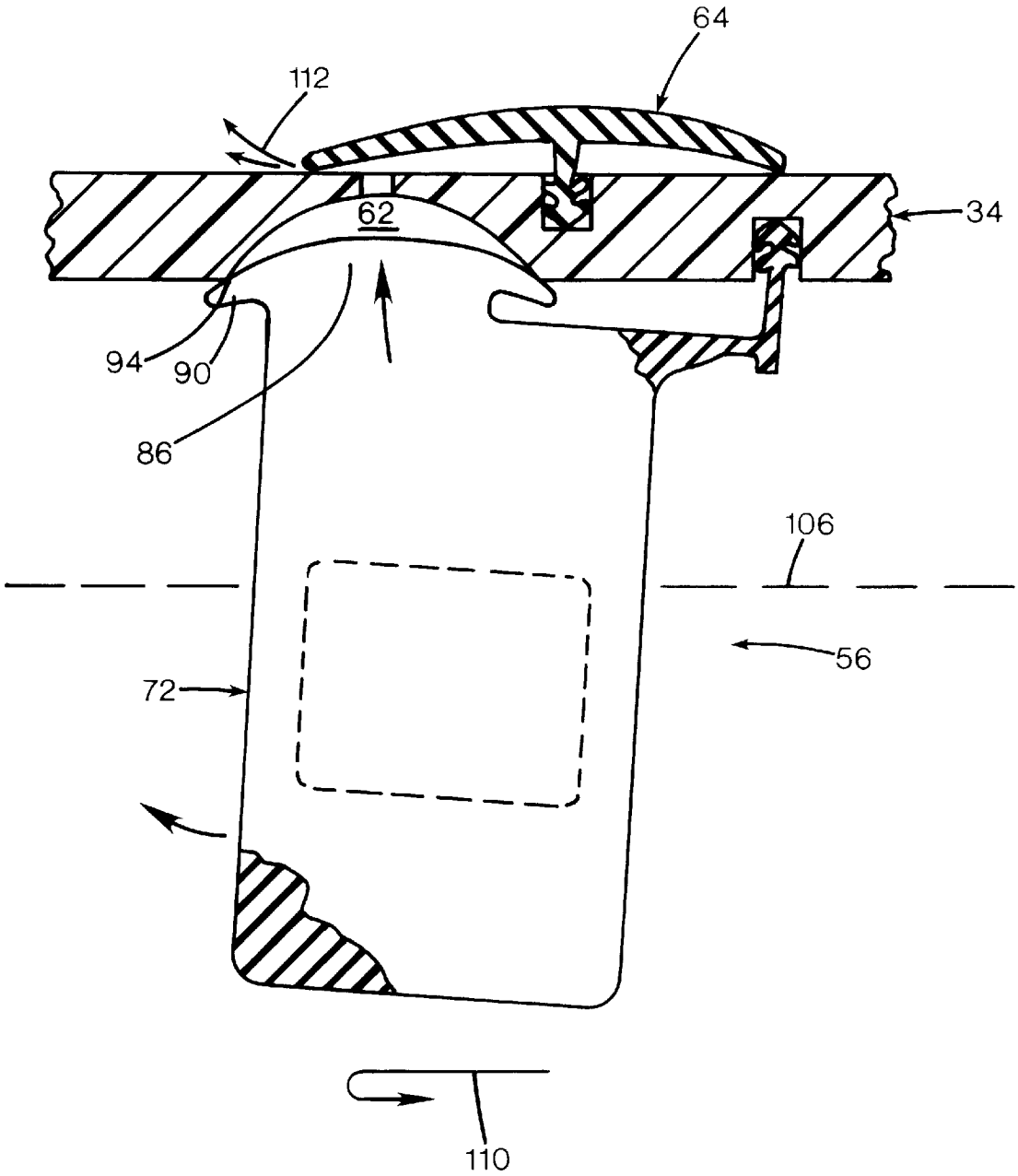

As the mass element continues to move leftward and upward, the neck of the compressor 86 forces into the chamber 62 and the rim 90 bends downward, as shown in FIG. 5. As the pressure in the chamber is brought up to external ambient pressure from the slight underpressure or partial vacuum of the cartridge chamber, no air escapes. When the compressor chamber pressure exceeds ambient, plus any small effect of biasing force of the check valve 64, an air stream 112 exhausts at the periphery of the check valve. After maximum carriage acceleration or maximum upward force by the compressor, a partial vacuum at lower pressure than the cartridge interior tends to hold the mass in the position shown. The weight of the mass may be adequate to overcome the suction; if not, the additional inertial force of the next opposite lateral acceleration as shown in FIG. 3 will be adequate to do so.

For each carriage reciprocation when the ink level is below the threshold level 106, the mass shifts to cause the pump to "burp" or exhaust a small quantity of air out of the chamber. This assists the drawing of ink into the chamber when remote sources are used. To also reduce bubbles forming below the screen 42, such as bubble 114 shown in FIG. 2, a small conduit (not shown) between the lower chamber and upper chamber can allow the lower bubbles to escape to the upper chamber for evacuation. Alternatively, the compressor assembly may be positioned in or near the lower chamber, possibly with a conduit extending to an air inlet at its upper end in the upper chamber.

Figure 6:
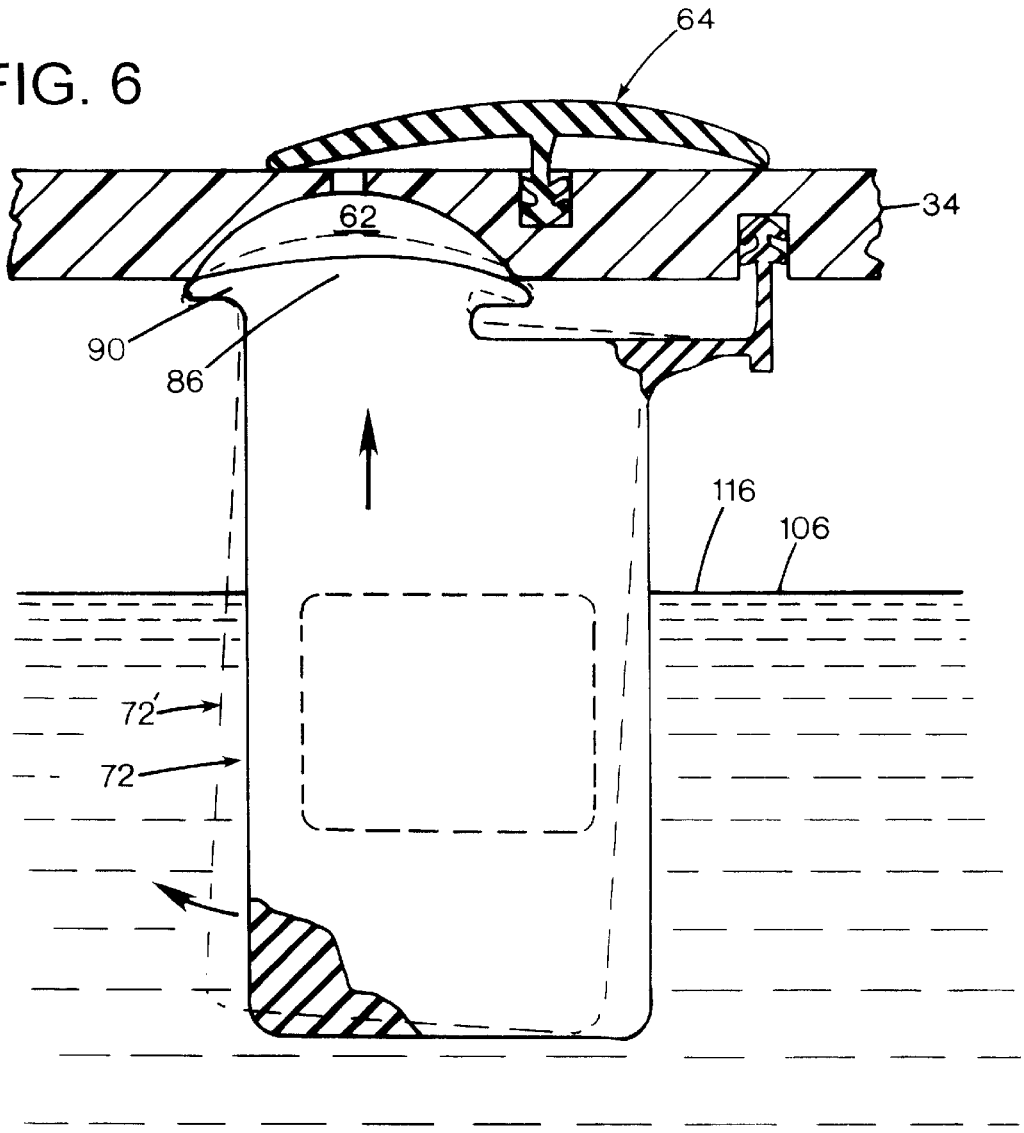

To prevent pumping from continuing excessively, which would eventually cause expression of ink through the air outlet after all air has been expelled, an ink-level-sensitive buoyancy mechanism prevents pumping when enough air has been evacuated to bring the ink up to a preselected threshold level 106. As shown in FIG. 6, ink 1 16 has risen to the threshold level 106. This provides adequate buoyant force to prevent the compressor chamber suction (generated as shown in FIG. 5) from being broken by the combination of the weight of the mass element 72 and the reciprocation acceleration of FIG. 3. When ink is at or above the threshold, the compressor remains suctioned to the chamber 62, and generates a varying vacuum as the carriage reciprocates, with the mass element moving between positions 72 and 72' (dashed lines). Essentially, the buoyancy pumping limit feature prevents the intake phase, temporarily disabling the pump.

ALTERNATIVE EMBODIMENTS

The preferred embodiment is only one possible type of inertially driven pump. The inertial mass used for pumping may be inside or outside of the ink chamber. The ink itself may be used as the movable mass, with a movable rudder or impeller responding to ink sloshing and transmitting force to a compressor. Such a rudder might have a horizontal pivot axis positioned at the middle of the rudder to neutralize pumping forces as the ink rises to interact with the upper rudder portion.

In another alternative, a simple piston pump may have the piston connected to or serving as the moving mass. A check valve may be provided at an inlet to the compression chamber in addition to the check valve at the outlet as shown in the preferred embodiment.

An inlet check valve in any embodiment could be replaced by a flow restrictive capillary, which would resist air transmission during the rapid compression, but which would slowly admit intake air to equalize compressor chamber pressure for the next compression stroke. Such a capillary intake valve/restrictor could be employed in a variant of the illustrated embodiment in which a diaphragm covers the lower portion of the compressor chamber to form a diaphragm pump. The capillary would provide the only communication between the ink chamber and the compressor chamber, and with the moving mass simply pushing on the diaphragm, without the gasket seal required in the preferred embodiment.

An inertially activated peristaltic pump may be employed to avoid complications that may be associated with valving in certain applications.

Another type of pump may use a pendulous tube chamber with a mass at its lower end, whereby the flexing of the tube reduces its volume, forcing air from the tube out of the air outlet. An inlet check valve or capillary retains adequate air pressure during the exhaust phase.

For applications in which there is a capacity for air in the upper chamber, and only the lower chamber presents a bubble concern, an inertially activated pump may have an inlet in the lower chamber and an outlet in the upper chamber. A shut-off feature would be unnecessary for such a pump, as a constant cycling of ink would merely cause repeated and potentially beneficial filtering of ink through the screen, without leakage or waste of ink.

Although the pump is shown as connected to the ink cartridge, portions may be connected to the carriage or other printer components. For instance, a single inertially driven vacuum pump may be provided with a manifold to draw air from any or all of multiple ink cartridges. Alternatively, an inertially driven mechanism outside of the ink cartridges may actuate pump elements such as a diaphragm on each cartridge.

To provide higher pumping pressures, pumps or compressors may be serially combined. For applications requiring more pumping volume, an additional pump may provide pumping on the reciprocation stroke contrary to the illustrated pump.

While the above is discussed in terms of preferred and alternative embodiments, the invention is not intended to be so limited.

What is claimed is:

1. An ink jet print cartridge comprising:

a body defining an ink chamber;

a movable inertia element connected to the body;

the body defining an air outlet; and a compressor element connected to the inertia element and in communication with the air outlet.

2. The ink jet print cartridge of claim 1 wherein the inertia element is inside the chamber.

3. The ink jet print cartridge of claim 1 wherein the inertia element is integral with the compressor element.

4. The ink jet print cartridge of claim 1 including a check valve associated with the air outlet and operable to prevent air entering the chamber by way of the air outlet.

5. The ink jet print cartridge of claim 1 wherein the compressor element includes a flexible portion defining a compression chamber in communication with the air outlet.

6. The ink jet print cartridge of claim 1 wherein the inertia element is pivotally attached to the body at a pivot position and includes a depending portion depending downward from the pivot position.

7. The ink jet print cartridge of claim 1 wherein the inertia element includes a buoyant portion.

8. An ink jet printer comprising;

a carriage operable for reciprocation along a carriage axis;

a print cartridge connected to the carriage;

the print cartridge having a body defining an ink chamber;

a movable inertia element connected to the body and movable in response to reciprocation of the carriage;

the body defining an air outlet; and a pump element connected to the inertia element and in communication with the air outlet, such that the pump element is operable in response to movement of the inertia element to force air out of the ink chamber by way of the air outlet.

9. The ink jet printer of claim 8 wherein the inertia element is inside the chamber.

10. The ink jet printer of claim 8 wherein the inertia element is integral with the pump element.

11. The ink jet printer of claim 8 including a check valve associated with the air outlet and operable to prevent air entering the chamber by way of the air outlet.

12. The ink jet printer of claim 8 wherein the pump element includes a flexible portion defining a pump chamber in communication with the air outlet.

13. The ink jet printer of claim 8 wherein the inertia element is pivotally attached to the body at a pivot position and includes a depending portion depending downward from the pivot position.

14. The ink jet printer of claim 8 wherein the inertia element includes a buoyant portion.

15. A method of evacuating air from an ink jet print head comprising the steps:

providing an ink jet printer having a carriage supporting a print cartridge defining an ink chamber with an air outlet;

reciprocating the carriage along a carriage axis;

in response to reciprocating, moving an inertial element in the cartridge relative to the cartridge; and in response to moving the inertial element, operating a compressor to force air out of the chamber by way of the air outlet.

16. The method of claim 15 wherein moving the inertial element includes pivoting the inertial element about a pivot axis angularly offset from the carriage axis.

17. The method of claim 15 wherein operating the compressor includes pressing a portion of the inertial element against the air outlet.

18. The method of claim 15 including limiting a motion of the inertial element when the chamber is filled with ink above a preselected level.

19. The method of claim 18 wherein limiting the motion of the inertial element includes generating a buoyant force.

20. The method of claim 15 including preventing passage of air through the air outlet when the chamber is filled with ink above a preselected level.

* * * * *